US009033196B1

(12) United States Patent
Smith

(10) Patent No.: US 9,033,196 B1
(45) Date of Patent: May 19, 2015

(54) PRE-THREADED AND KNOTTED HAIR WEAVING NEEDLE AND METHOD

(71) Applicant: Ta'Nisha Shanae Smith, San Antonio, TX (US)

(72) Inventor: Ta'Nisha Shanae Smith, San Antonio, TX (US)

( * ) Notice: Subject to any disclaimer, the term of this patent is extended or adjusted under 35 U.S.C. 154(b) by 0 days.

(21) Appl. No.: 13/793,996

(22) Filed: Mar. 11, 2013

Related U.S. Application Data

(60) Provisional application No. 61/685,093, filed on Mar. 12, 2012.

(51) Int. Cl.
*D05B 91/16* (2006.01)
*A41G 5/00* (2006.01)
*D05C 1/00* (2006.01)

(52) U.S. Cl.
CPC ..... *A41G 5/0086* (2013.01)

(58) Field of Classification Search
CPC ..... D05B 85/00; D05B 87/00; D05B 91/00; D05B 91/12; D05B 91/16; B65D 85/24; B65D 85/00; B65D 85/04; A45F 3/48; D05C 1/00
USPC ..... 223/102, 106, 108, 109 R; 112/222; 206/380, 382, 574; 606/146, 224, 225
See application file for complete search history.

(56) References Cited

U.S. PATENT DOCUMENTS

| | | | | | |
|---|---|---|---|---|---|
| 1,705,050 | A * | 3/1929 | Taylor | 206/388 |
| 1,818,694 | A * | 8/1931 | Corbett | 242/164 |
| 1,968,101 | A * | 7/1934 | Stewart | 242/118.7 |
| 2,750,651 | A * | 6/1956 | Saito | 28/150 |
| 3,180,487 | A * | 4/1965 | Uddenborg | 206/227 |
| 3,206,086 | A * | 9/1965 | Duffney | 223/102 |
| 3,357,550 | A * | 12/1967 | Holmes et al. | 206/63.3 |
| 3,603,492 | A * | 9/1971 | Schantz | 223/109 R |
| 4,049,006 | A | 9/1977 | Saunders et al. | |
| 4,782,954 | A * | 11/1988 | Reynolds | 206/574 |
| 4,934,387 | A | 6/1990 | Megna | |
| 5,074,874 | A * | 12/1991 | Yoon et al. | 606/224 |
| 5,107,867 | A | 4/1992 | Barrington | |
| 6,510,856 | B1 | 1/2003 | Ahn | |
| 7,036,518 | B2 | 5/2006 | Park | |
| 7,246,623 | B2 | 7/2007 | Arroyo et al. | |
| 7,320,327 | B2 | 1/2008 | Frazier | |
| 7,328,709 | B2 | 2/2008 | Smith | |
| 7,458,383 | B2 | 12/2008 | Song | |
| 7,469,701 | B1 | 12/2008 | Bernard | |
| 7,854,233 | B2 | 12/2010 | Freelove | |
| 7,862,613 | B1 | 1/2011 | Costabile | |
| 7,992,576 | B2 | 8/2011 | Chang | |
| 8,047,210 | B2 | 11/2011 | Lee | |
| 8,336,559 | B2 | 12/2012 | Kallabat et al. | |
| 2004/0020795 | A1 * | 2/2004 | Braginsky et al. | 206/63.3 |

* cited by examiner

*Primary Examiner* — Ismael Izaguirre
(74) *Attorney, Agent, or Firm* — Charles W. Hanor

(57) ABSTRACT

A pre-threaded and knotted needle with a length of thread knotted though the eye of the needle and a connection securing the ends of the thread and a sleeve securing a bundle of the thread so that the thread is not tangled until it is released and ready for use The thread is bundle is formed by wrapping it into a bundle and securing a sleeve around the bundle of the thread so that the thread is not tangled until it is released and ready for use. The bundle is released for use by pulling on the needle and the end of the thread to release the bundle of thread.

6 Claims, 1 Drawing Sheet

PRE-THREADED AND KNOTTED HAIR WEAVING NEEDLE AND METHOD

CROSS-REFERENCE TO RELATED APPLICATIONS

This application is based on U.S. Provisional application No. 61/685,093 filed Mar. 12, 2012.

STATEMENTS REGARDING FEDERALLY SPONSORED RESEARCH OR DEVELOPMENT

NONE

REFERENCE TO A MICROFICHE APPENDIX

NONE

BACKGROUND OF THE INVENTION

1. Field of the Invention

The invention relates to the field of hair weaving and in particular relates to pre-threaded and knotted hair weaving needles for attaching wefts of hair. The thread is wound up and secured with a sleeve so that the thread does not tangle and can be fully released for use.

2. Description of the Related Art

Hair weaving, also popularly known as hair integration, is a technique, where a new set of hair is added to existing hair. This method allows individuals to get the desired hairstyles by adding more volume and length to their original hair. This technique is also particularly helpful for those who are facing the problem of hair thinning or balding. There are several types of hair weaving styles out of which bonding, tracking, fusion, netting or net weaving, and tree braiding are some of the most widely used techniques. Both natural and synthetic hair can be used as hair extensions.

Bonding is one of the most widely used technique where hair is separated into several sections and the pieces of weaved hair is added to the natural hair, close to the scalp by using hair glue. This is a temporary method of hair weaving that does not damage the natural hair. But remember that it should be done by a professional. Even to remove hair extensions, you should either take the help of a professional or follow the instructions properly. Not following the instructions can translate to a lot of hair damage.

Fusion is one of those techniques that give a truly natural look by making the weaving unrecognizable from the original hair. Here a machine is used to glue hair to the natural hair strands. For this, the natural hair has to be sectioned off into several small and slender sections. Then the machine is heated in order to attach the new hair to each of the sectioned hair strands. But the high heat applied can cause damage to hair and skin, and hence, sufficient care and precautions required to be followed. This method is quite expensive and time-consuming, but it can give a natural look and the hair can be washed and maintained as usual. Nowadays, another technique is available, which is known as cold fusion, which does not require the use of a heating machine.

Tracking is method of hair integration that involves braiding the natural hair into several tracks across the head. Here, a few concentric circles of braids are created and sewn. Now, the weave or new hair is sewn horizontally or vertically to the braids. Generally, hair is braided into cornrows in order to sew in the weave hair. This method of creating concentric circles of cornrows and then sewing the weave is one of the most popular African-American hair weaving methods. This type of hair weaving, however, requires a lot of care and can be properly done only by a professional.

Net weaving or netting is a permanent technique of hair weaving that is especially suitable for those experiencing hair thinning or balding. Net weaving involves braiding of the natural hair and then attaching a very thin net on it. The net serves as a surface on which the new hair or hair extensions can be woven. It can last for two to three months, but requires proper care and maintenance. An advantage of this technique is that it does not cause any damage to hair unlike fusion technique. You can also wash your hair once in a week, provided you dry out your hair completely.

Invisible or tree braiding is more popularly known as tree braiding and it is a temporary technique employed for hair weaving. But this technique can give a completely authentic look, in the sense that the weaved in hair looks natural. To add hair extensions, the natural hair is parted in the middle to create a basic cornrow braid. Then the artificial hair is added just at the beginning of the cornrow braid. The process is a bit tricky and can be done perfectly by an expert hair care professional only. The artificial hair extensions can completely blend with the natural hair to give a stunning look.

These techniques are excellent for integrating artificial hair in order to add style, volume, and length to the existing hair. With the latest developments in this area, hair weaving has evolved to a great extent, so that weaved hair looks almost undetectable. However, most of the techniques require the help of an expert and certified professional to ensure that no damage is done to your natural hair in the process.

Hair weaving is the popular method of installing a new set of hair into the existing hair. The technique of hair weaving is also known as hair integration. Hair weaving extensions are now also available in the form of lace extensions that are applied to a particular part of the scalp. People suffering with hair loss problems and those who are just not satisfied with their hair, can reap greater advantages of hair weaving instructions than those who are blessed with naturally beautiful hair that can be worn in any hairstyles that they wish. Hair weaving is one of the easiest techniques of installing hair extensions. It is arguably the most popular technique because it doesn't have any side effects that are caused by some other hair installation methods that are time-consuming and use different chemicals and glues. Hair weaving is actually done by using a needle and a thread, just like sewing a cloth. Before weaving hair, you make sure that the hair and the scalp is properly clean and dry. The foremost step in hair weaving is braiding the hair into tracks. These tracks later on serve as the base for the hair extension fillings. Before following the hair braiding instructions, be sure about the braided or hair weave style that you want to wear.

It is good if you create smaller braids so that they can be easily hidden. You may create the tracks from the back side of the head and create horizontal partitions or vertical partitions. This will serve as a section for the braiding. After making the section you simply do the cornrow braid style and keep on making braids as per the necessity. The braids should be strong but not too tight. Too tight braids can create sores and scalp irritations. You can cut the hair extension welts and hold them against your scalp to determine the exact width that is required for the hair installation and then begin the process of installation. The hair extension weft needs to be attached to the hair tracks that you have previously created. You should make sure you choose the thread color, exactly the same as the color of your hair so that it can be camouflaged easily under the hair.

You typically use a C-shape needle and tie the thread to the needle. You initially place the needle at the very end of the weft till you reach to the knotted end of the wefts for hair extension. You put it against the hair track and slowly start sewing the weft into the hair. You should make sure you don't create any gaps so that the wefts are placed tightly to the scalp. On reaching the end of the hair braid, you can cut off the remaining weft of the hair extension and secure the sewing by making a small knot or you can move it to the next hair braid without cutting the weft. When you finish sewing a weft of added hair you can cut all the loose ends of the thread and then begin the same procedure with the needle and a new welt of hair. On completing the hair weaving, you brush down the hair, in order to complete the hairstyle. It is good if you go to a hair specialist and get your hair weaving done. Hair extensions can last for at least three months and you can remove hair extensions very easily too.

The first thing that you do with the prior art needles is to cut off a piece of thread, thread the needle, tie off the ends and then start applying or inserting the needle from the beginning of a braid and then extending the needle over about half of an inch, under and over and you continue this until the thread is used up. It takes time to thread the needle and may be difficult for some hair weavers.

U.S. Pat. No. 4,049,006 shows a hair-weaving machine includes two endwise juxtaposed threaded shafts having a gap formed there between and two arms provided with grippers which may be rotated in a clockwise and anticlockwise directions around the shafts, respectively. As the arms are slowly advanced in the same directions longitudinally along the respective shafts, one arm with its gripper pushes a needle-attached thread through an end portion of a hairpiece and past a strand of hairs, while the other arm and its associated gripper grips the needle after the latter has been pushed through the end portion of the hairpiece and past the strand of hairs, and returns the needle and its associated thread subsequently to the first arm. The next action of the first gripper arm results in a complete loop being formed around the hairpiece end portion and the strand of natural hairs, subsequent loops being formed as the arms are advanced longitudinally along the respective shafts. A spool with a torsion spring attached to the frame of the machine keeps the thread tout at all times, which results in the formation of tight loops.

U.S. Pat. No. 4,934,387 shows a process for lengthening the hair of persons having short hair and for thickening the hair for those having a relatively small amount of hair, which process comprises the steps of aligning supplemental hair with the natural hair, adhering the supplemental hair to the natural hair utilizing a colored thermoplastic glue, intertwining the warm adhered natural and supplemental hair together to permit a binding of the supplemental to the natural hair, and then styling the combined hair. A technique for preparing the thermoplastic glue is also disclosed.

U.S. Pat. No. 5,107,867 shows a reversible process for attaching permanent extensions to human hair in which strands of supplemental hair are joined with a thermostable adhesive to form a plug of supplemental hair, a coating of thermosetting adhesive is applied over the thermostable adhesive and cured, strands of the person's natural hair are threaded through a section of heat shrinkable tubing, the plug of supplemental hair is inserted into the heat shrinkable tubing, and heat is applied to the heal shrinkable tubing so that the thermosetting adhesive liquefies and joins the plug of supplemental hair and natural hair, and the heat shrinkable tubing shrinks in size to compress and seal the junction. The permanent extension can be removed by reapplication of heat to the heat shrinkable tubing.

U.S. Pat. No. 6,510,856 shows an apparatus and method for the attachment of supplemental hair to existing natural hair. The apparatus comprising a first comb member, a handle attached at a back end thereof, and a second comb member hingeably or pivotally attached thereto. A row of first teeth extends from the first comb member corresponding to a row of second teeth extending from the second comb member. The second comb member is positioned to be moveable interchangeably between a closed position and an open position. A heating member connects to and provides heat to one or both of the first comb member and second comb member. The apparatus is utilized in a process to attach supplemental hair to existing natural hair of a person's head. The method uses rows of supplemental hair pre-attached to a band member. An adhesive member is pre-hardened on each row of supplemental hair at a predetermined distance near the band member. With the second comb member in the open position, the rows of supplemental hair strands of natural hair are placed between each tooth of the row of first teeth. The second comb member is moved to the closed position for a predetermined period of time long enough to allow the pre-hardened adhesive to melt sufficiently to adhere the rows of supplemental hairs.

U.S. Pat. No. 7,036,518 shows a method of attaching supplemental hair to natural human hair begins with selecting a plurality of strands of human hair growing from a scalp. A supplemental hair bundle includes a plurality of supplemental hair strands previously glued to one another at a glued portion by thermoplastic glue. The glued portion is fused using a heating element of an applicator. The glued portion of the supplemental hair bundle is then contacted to the selected plurality of strands of human hair. The heating element may be a heated jaw having a heating channel shaped to receive the glued portion of the bundle. A kneading jaw in opposing relationship to the heating jaw may be used to clamp the human hair and the supplemental hair bundle and mix the glue into the strands of human hair. Bundles are made by placing supplemental hair strands in a film of fused glue on a rotating cylinder.

U.S. Pat. No. 7,246,623 shows a system for applying hair extensions to natural hair growing on the scalp of an individual comprises flared cylindrical tubes, a threading hook and a crimping tool. The threading tool is used to feed scalp hair through the flared tube. The hair extension is then inserted into the flared end or the tube and the tube is crushed flat trapping the threaded scalp hair and hair extension within the crushed structure. The removal of the hair extension is facilitated by use of a removal tool designed to open the crimped flared tube.

U.S. Pat. No. 7,320,327 shows a embodiments of wefts for hair extension attachments include attachment strands extending from the weft base or edge of the attachment. These attachment strands are braided or intertwined directly into the braids formed in the native hair of the wearer as those braids are being formed, without need for additional sewing and thread, adhesives, or other attachment apparatus. The weft base may comprise a relatively narrow, linear weft edge having the hair strands and attachment strands extending in the same direction therefrom, or may comprise a two-dimensional crown sheet having the hair strands extending from a series of wefts from one surface of the sheet and the attachment strands extending from the opposite surface. Each embodiment may include a separator sheet between the hair strands and the attachment strands, to facilitate the manipulation of the attachment strands during installation.

U.S. Pat. No. 7,328,709 shows an article and method for supplementing scalp hair. The article includes a body having at least one aperture formed there through and a plurality of fibers. Each fiber is threaded through an aperture and around the body. Scalp hair is threaded through a body aperture and body position adjacent the scalp. Crimping of the body secures the article to the scalp hair.

U.S. Pat. No. 7,458,383 shows a weft for hair extension and a method of extending the weft for hair extension to real hair that provides a plurality of space portions through which the real hair is passed between a pair of wig hair bundles that are bound to form the welt for hair extension and fixedly extends the real hair that is passed through the space portions to the weft for hair extension by use of a plurality of pressure rings.

U.S. Pat. No. 7,469,701 shows a method of mounting a hairpiece including a hairpiece strip of flexible sheet material and hairpiece strands secured to the strip using an anchor tube, includes the steps of providing anchor tube; parting wearer hair along a part line; placing the hairpiece strip against the part line; piercing the hairpiece strip to form a first hair port; drawing a first bundle of wearer hair strands outwardly through the first hair port; fitting the first bundle into the anchor tube and advancing the anchor tube along the first bundle into close proximity with the hairpiece strip; looping the first bundle back toward the strip and outward again through the anchor tube; tying the first bundle to the anchor tube; and crimping the anchor tube to engagingly grip the first bundle and thereby secure the hairpiece strip relative to the wearer scalp.

U.S. Pat. No. 7,854,233 shows a hair extension device that allows a user to add supplemental, natural, human hair strands to the natural hair of the user. The hair extension device includes a filament formed into a circular or oval shape to encircle the head. Hair weft lengths are attached to the filament along an arcuate length of the filament. When the device is positioned on the head, the hair strands of the hair weft lengths extend down the sides and back of the user. The natural hair held beneath the filament is pulled up and forward, then backward over the filament, blending together the natural hair of the user and the supplemental hair strands.

U.S. Pat. No. 7,862,613 shows a fitting and a method for utilizing one or more of such fittings are described for securing supplemental hair to a person's head, along the outer surface of the person's scalp, to create an enhanced, natural appearance independent of the population and location of any natural hair on the person's head. Each fitting includes a base and a longitudinal bridge rising from the base to establish an eye providing a lateral path beneath the bridge. Each base is embedded beneath the outer surface of the person's scalp to secure the corresponding fitting at a selected strategic location on the person's head with the bridge projecting from the outer surface to provide a corresponding attachment site. Supplemental hair is juxtaposed with and secured to each bridge with a corresponding ligature passed through the eye of each corresponding bridge.

U.S. Pat. No. 7,992,576 shows a hair extension kit enables user's hair to be coupled with extended hairs, and includes a fastening ring formed in a hollow shape, each respective upper end of the extended hairs being attached to an inner peripheral surface of the fastening ring; a guiding loop having a portion thereof received in the fastening ring and a guiding and holding part formed at the lower end thereof, the guiding loop being removable from the fastening ring; and a drawing loop having a portion thereof received between an inner wall of the fastening ring and the corresponding part of the guiding loop and a drawing and holding part formed at the lower end thereof, the drawing loop being removable from the fastening ring. The hair extension kit can increase the coupling force between the user's hair and the extension-hair via the fastening ring.

U.S. Pat. No. 8,047,210 shows a hair extension for attachment to a hair is provided. The hair extension comprises an extending hair portion and a thread connected to the extending hair portion and configured to be tied to a hair to create an attachment. A ring portion is formed between both ends of the thread for inserting the hair, tightening, and fixing to the inserted hair.

U.S. Pat. No. 8,336,559 shows a hair extension system provides a skin weft of flexible material having hair like fibers uniformly displaced thereon. Micro rings are fixed to the skin weft and provide an anchoring feature for strands of human hair from a scalp to be secured thereto. The micro rings are deformable and include a flexible protectant so as to minimize damage to the strands of hair. The hair system may be reused by re-opening the micro rings and reinstalling the hair extension system to another location.

BRIEF SUMMARY OF THE INVENTION

The invention includes a pre-threaded and knotted needle. The needle has a point at one end and an eye at the other end. A length of thread knotted though the eye of the needle and a connection secured the ends of the thread. A sleeve secures a bundle of the thread so that the thread is not tangled until it is released and ready for use The sleeve may be cylindrical in cross-section. The needle may be C-shaped. The connection securing the ends of the thread may be a knot or the ends of the thread may be connected by fusing. The bundle comprises a winding of the thread and compression of the winding so it fits within a sleeve. The thread is made of natural fiber or synthetic fiber.

The pre-threaded and knotted needle is used by bundling the thread having connected ends and inserted into the eye of a needle by wrapping it into a bundle. The bundle of the thread is secured by a sleeve so that the thread is not tangled until it is released and ready for use.

The bundle is released for use by pulling on the needle and the end of the thread to release the bundle of thread or by pulling on the needle and sleeve to release the bundle of thread.

An object of the pre-threaded and knotted needle kits of the invention is to decrease frustration, save time, are easy to use, decrease's transmission of diseases such as HIV and Hepatitis and prevent infections such as ringworm, lice, fungus and bacteria.

Another object of the pre-threaded and knotted needle kits of the invention is to facilitate sanitary use.

Another object of the pre-threaded and knotted needle kits of the invention is to facilitate making the needles disposable so you can use and dispose of used needles.

Another object of the pre-threaded and knotted needle kits of the invention is make hair weaving much faster.

Another object of the pre-threaded and knotted needle kits of the invention is to make hair weaving more sanitary.

Other objects of the pre-threaded and knotted needle kits of the invention will be apparent from the drawings and detailed disclosure.

DETAILED DESCRIPTION OF THE INVENTION

Figure 2:
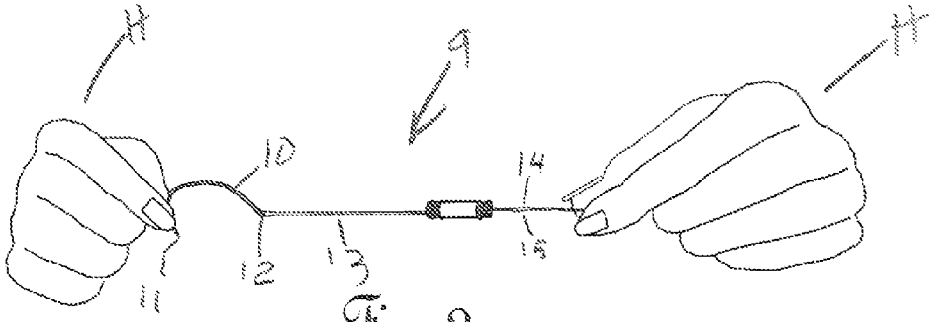
FIG. 2 is shows the thread being pulled out of its holder for us.
Figure 1:
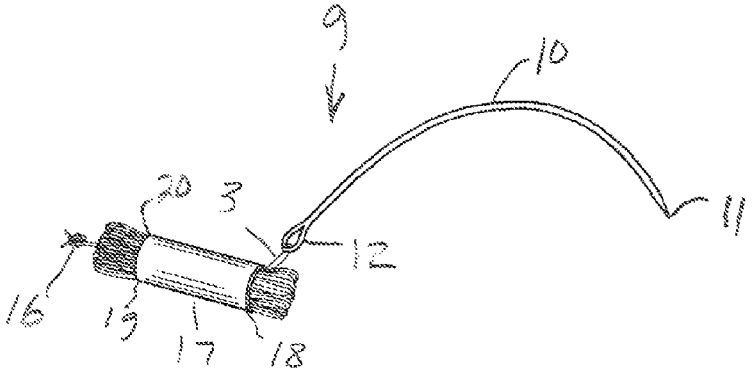
FIG. 1 is view of the invention before use.
Figure 3:
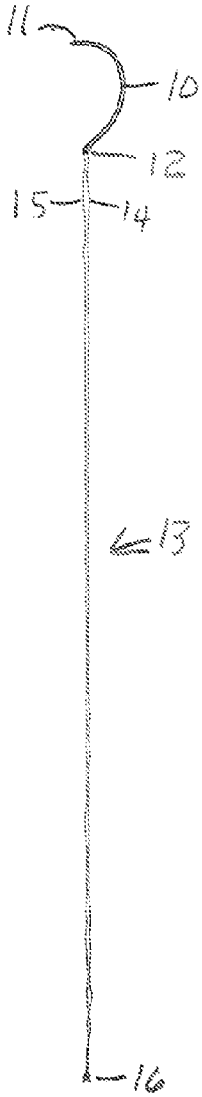
FIG. 3 is shows the needle and thread extended for us.

The weaving needles for attaching wefts for hair extensions are shown in FIGS. 1-3. The pre-threaded and knotted semi-curved hair weaving needle 9 is described as follows. The need is a very fine slender piece of semi-curved polished metal with a point at one end and a hole or eye at the other end. The eye or hole of the needle has a single strand of hair weaving thread that may be about 72 inches in length inserted through the eye or hole that is folded in half making two strings parallel of about 36 inch length each which are secured together at the ends forming a single knot or multiple knots.

The most common hair weaving needles used are the L-shaped needle, the C-shaped needle and the straight needle. Other shapes of needles could be used depending on the application.

As shown in FIG. 1, the there is a curved C-shaped needle 10 having a generally round cross-section and a pointed end 11 and an eye or loop end 12. The eye or loop end 12 is small and is of sufficient size to allow the insertion of a thread in it. While a C-shaped needle is commonly used, straight needles and curved tip or A-shaped needles are also sometimes used. The shape of the needle depends on the preference of the used and the application of the weaving.

The needle 10 includes a looped thread 13 that is inserted into the eye 12. The looped thread 13 includes two thread sections 14 and 15 that extend through the eye 13 and are secured together with a connection such as a knot 16. The connection may be multiple knots so that the end of the thread does not pull through the weft during weaving. Other suitable connections include bonding with heat fusion or adhesive or similar fusion to secure or connect the ends of the two thread sections 14 and 15.

The looped thread sections 14 and 15 are each typically 36 inches in length each. The thread may be made of natural fibers such as cotton or synthetic fibers such as nylon or other suitable thread material. The thread is typically colored to closely match the color of the hair in the weft and of the hair of the person that is receiving the hair weaving.

The pre-threaded and knotted needle as shown in FIG. 1 includes a bundle that allows it to be packaged with multiple pre-threaded and knotted needles without getting the threads tangled. This is done by winding the looped thread around an object, which may be cylindrical, so that the bundle is about an inch long when compressed into a cylindrical shape as shown in FIG. 1. A cylindrical retainer cover or sleeve 17 having ends 18 and 19 is provided to retain the bundle of the looped thread in an untangled orientation as shown in FIG. 1. The sleeve 17 may be made of paper, plastic or other suitable disposable material. The bundle is inserted into the sleeve when compressed and retained there during shipment and sales until it is ready to use. The inside cylindrical surface 20 of the sleeve 17 contacts the bundle and has an inside diameter that grips the bundle and holds it during shipping until it is ready to be used by a hair weaver. The bundle of thread may be pulled though the sleeve using a hooked tool similar to a crochet hook.

To use the pre-threaded and knotted needle 9, one grasps the needle 10 in one hand H and the knotted end 16 in the other hand H and pulls them apart as shown in FIG. 2. If the knotted end 16 does not extend out of the sleeve one can grasp the sleeve and pull it off of the bundle and then shake out the bundle and pull the knotted end to extend the thread as shown in FIG. 3. Once the thread is fully extended as shown in FIG. 3 the sleeve 17 is discarded. You may need to shake out the bundle of thread to straighten it as shown in FIG. 3.

The hair weaving works as follows. A first step is you need to clean the hair and get the hair shampooed. After you do that you're going to mold the hair by either wrapping it or braiding it. And after you sew-in wefts of hair by adding in hair on top of your braids. It can be synthetic hair or it can be real hair from anywhere. You may also braid the hair with yarn or other materials to add decoration or color.

Usually the client has their hair braided. You purchase either synthetic or real hair, which comes in a track. You take this track and you begin the sew-in process. You would typically take a bag of hair, which are called tracks which tracks come in wefts. You pick the colors you want which can typically be black, brown, gray or blond. The tracks come in many different colors. You take the track and place it on top of your braids before you start your sew-in. You can either cut the track or you can keep sewing on top of the braids. You can just keeping sewing and sewing until you finish a weft and sewing.

With the pre-threaded and knotted needles of the invention you can merely open a package of 10 or more pre-threaded and knotted needles and began sewing. You add hair tracks to each braid to make the hair look bulkier or bigger. You keep adding tracks onto your braids. You could add multiple tracks to a braid. You can also add in extensions by sewing them into the person's hair. You basically you lay the track of hair alongside the braid and start sewing it in. The thread should be the same color as the hair so that it can blend and so you won't see the thread. The thread is about a good arm's length and can be more than an arm's length. You typically do not want it to be longer than an arm's length because it could tangle.

Pre-threaded and knotted needles make hair weaving much faster and much more sanitary. A hair weaver is not supposed to ever reuse the needle on different persons because it is not sanitary. Some customers have scalp disorders like fungus and bacteria and other problems like AIDS.

Some hair weavers have to thread one needle over and over again. They may use that same needle on every customer. Some may not sanitize the needles. The used needles should go into a sharps container. They might also be put into a disinfecting solution to sanitize them. During use a needle can poke and penetrate the customer's scalp or the hair weaver's in fingers and hands H. When you are sewing you get stuck often with the point of the needle you get stuck in the head every time.

The pre-threaded and knotted needles reduce the time required for hair weaving and increase the efficiency of the hair weaver. They also promote good health of hair weaves and patients. The needle kits of the invention decrease's frustration, save time, are easy to use, decrease's transmission of diseases such as HIV, Hepatitis, ringworm and lice, are sanitary and are disposable so you can use and dispose of used needles.

The above-listed sections and included information are not exhaustive and are only exemplary or the invention. The particular sections and included information in a particular embodiment may depend upon the particular implementation and the included devices and resources. Although a system and method according to the present invention have been described in connection with the preferred embodiments, it is not intended to be limited to the specific form set forth herein, but, on the contrary, it is intended to cover such alternatives, modifications, and equivalents, as can be reasonably included within the spirit and scope of the invention as defined by the appended claims.

I claim:

1. A pre-threaded and knotted needle, comprising of:

a needle having a point at one end and an eye at the other end;

a length of thread looped though the eye of the needle and secured with a knot;

a connection for securing the ends of the thread;

a sleeve, cylindrical in cross-section, for securing a bundle of the thread so that the thread is not tangled until the bundle of thread is released and ready for use.

2. The pre-threaded and knotted needle of claim 1, wherein:

the needle is C-shaped.

3. The pre-threaded and knotted needle of claim 1, wherein:

the connection securing the ends of the thread is a knot.

4. The pre-threaded and knotted needle of claim 1, wherein:

the ends of the thread are connected by fusing.

5. The pre-threaded and knotted needle of claim 1, wherein:

the bundle comprises a winding of the thread and compression of the wound up thread so it fits within the sleeve.

6. The pre-threaded and knotted needle of claim 1, wherein:

the thread is made of natural fiber or synthetic fiber.

* * * * *